US007249722B2

(12) United States Patent
Cibotti

(10) Patent No.: US 7,249,722 B2
(45) Date of Patent: Jul. 31, 2007

(54) FUEL INJECTOR WITH HYDRAULIC FLOW CONTROL

(75) Inventor: Glen J. Cibotti, Wallingford, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/813,802

(22) Filed: Mar. 30, 2004

(65) Prior Publication Data

US 2005/0224593 A1 Oct. 13, 2005

(51) Int. Cl.
*F02M 61/20* (2006.01)

(52) U.S. Cl. ..... 239/533.9; 239/533.3; 239/533.4; 239/584; 123/299

(58) Field of Classification Search ..... 239/5, 239/533.3, 533.4, 533.9, 584, 533.8; 123/294, 123/299, 496

See application file for complete search history.

(56) References Cited

U.S. PATENT DOCUMENTS 4,958,605 A * 9/1990 O'Neal et al. ..... 239/533.4
5,397,055 A * 3/1995 Paul et al. ..... 239/533.8
RE34,999 E 7/1995 Kelly
5,647,536 A 7/1997 Yen et al.
5,852,997 A 12/1998 Vanderpoel
5,934,570 A * 8/1999 Lambert ..... 239/533.3
5,947,382 A 9/1999 Kelly
6,062,498 A 5/2000 Klopfer
6,454,189 B1 9/2002 Krishnamurthy
6,526,939 B2 3/2003 Reitz et al.
6,557,776 B2 * 5/2003 Carroll et al. ..... 239/5
6,568,369 B1 5/2003 Desai et al.

OTHER PUBLICATIONS

SAE Technical Paper Series, No. 900349, "Modulation of Injection Rate to Improve Direct Injection Diesel Engine Noise" by M.F. Russell, C.D. Young and S.W. Nicol, Mar. 1990.

* cited by examiner

*Primary Examiner*—Steven J. Ganey
(74) *Attorney, Agent, or Firm*—Alix, Yale & Ristas, LLP

(57) ABSTRACT

A fuel injector incorporates a flow control into the needle valve and valve body to regulate fuel flow through the injector. The flow control defines an initial pilot fuel flow path that is closed by needle valve movement away from the nozzle seat. A primary fuel flow path requires axial movement of the needle valve through a mid-range position in which neither fuel flow paths are open. At low engine speeds, the needle valve is not driven through its mid-range position and closes prior to being driven to its fully open position, resulting in a pilot injection. At higher engine speeds, the needle valve is driven through its mid-range position eliminating a distinct pilot injection to provide only rate shaping.

15 Claims, 5 Drawing Sheets

Figure 1

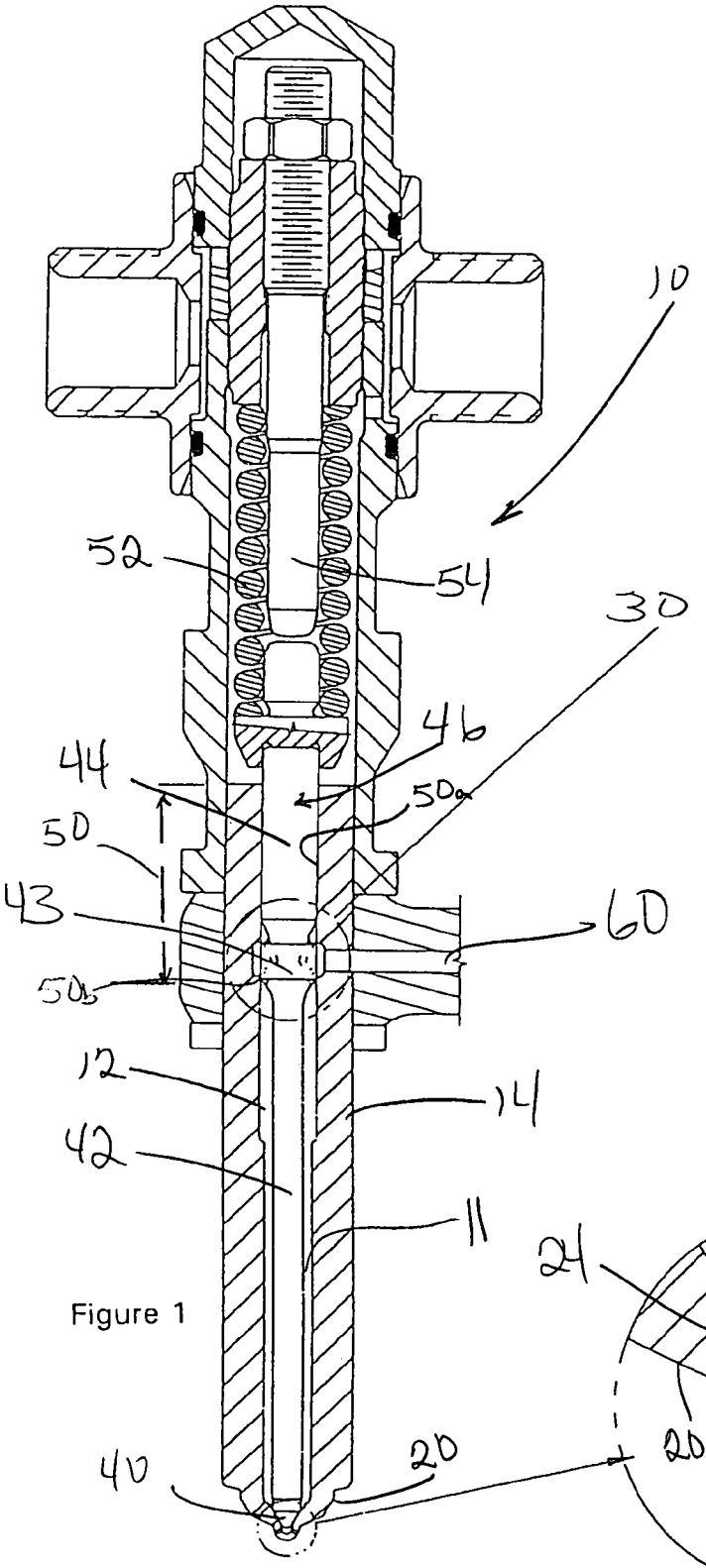
Figure 1
Figure 2
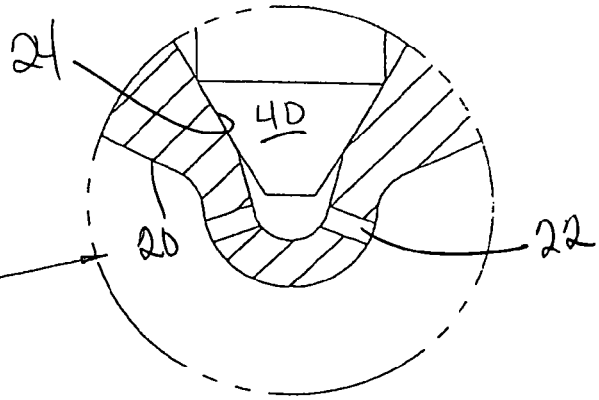

Needle Valve Fully Open

Mid-Range of Needle Valve Travel

Needle Valve Closed or Starting to Open

FUEL INJECTOR WITH HYDRAULIC FLOW CONTROL

FIELD OF THE INVENTION

The present invention relates generally to fuel injectors, and more particularly to fuel injectors configured to regulate the rate of fuel injection.

BACKGROUND OF THE INVENTION

Motor vehicles are required to comply with increasingly stringent limits on noise and emissions imposed by federal, state, and local regulatory bodies. Since published research has demonstrated noise and emissions from an internal combustion engine are influenced by the time history of the fuel flow rate through the injector spray holes, or injection rate shape, considerable effort has been expended to adjust and control the shape of this injection flow rate curve in response to the specific requirements of a particular engine application. Most hydraulic methods of regulating the flow rate at the injector involve either the use of a partial restriction or alternate flow path upstream from the nozzle spray holes to regulate the amount of fuel to reach the exit of the injector. The function of the alternate flow path in prior designs has typically been to divert a portion of the fuel to either an accumulator or the pump fuel supply system via a second external outlet located on the injector. A number of different approaches to implement these two methods have been taken.

Some injectors include two springs for biasing the needle valve toward its closed position. U.S. Pat. No. 4,938,193 to R. Raufeisen et al. entitled Fuel Injection Nozzle provides one example of this type. The two springs allow the injector to open in two stages. The needle valve opens a first distance under the influence of only one spring at a first pressure substantially lower than required to overcome the second spring preload. During this first stage of injection, the flow rate through the injector is throttled at the needle valve tip. Once the second stage opening pressure is reached, the needle valve moves to the maximum travel limit imposed by the needle lift adjusting screw to allow unrestricted flow to reach the injector spray holes. For many fuel systems the pump plunger motion and resulting rate of pressure rise in the system vary with engine speed. At idle and low engine speeds where the rate of pressure rise is low, sufficient time is available for the first stage operation to significantly influence the initial rate of fuel injection. As engine speed increases, the transition to second stage operation occurs more rapidly and lessens or eliminates the first stage regulation. Consequently, two spring systems typically provide rate-shaping at lower engine speeds, but not distinct pilot and main injections.

A further approach to regulate the flow rate through the use of throttling is outlined in U.S. Pat. No. 4,987,887 to W. Kelly entitled Fuel Injector Method and Apparatus. Two stage injector operation is obtained by metering fuel through a reduced radial clearance for a portion of needle valve travel before increasing the flow path area to provide unrestricted flow to the spray holes at the maximum limit of needle valve travel. With this type of flow path area to needle valve positional relationship, both rate regulation, and in some fuel systems utilizing a low initial rate of pressure increase, pilot injection, may be obtained with this type of injector in a design that can be manufactured at a relatively low cost.

An implementation scheme for diverting a portion of the fuel pump delivery is discussed in U.S. Pat. No. 5,647,536 to Yen et al entitled Injection Rate Shaping Nozzle Assembly for a Fuel Injector. Needle valve position is used to open and close flow rate limited spill paths within the injector to connect high pressure supply and low pressure drain circuits in the fuel system for a period of time during the injection. The flow rate of fuel entering the combustion chamber is claimed to change in a predetermined time varying manor as a result of this injector design.

Since power output, emission requirements, and economic constraints vary considerably with different engine applications, methods in addition to the above-discussed prior art are still required. One area of particular relevance is discussed in U.S. Pat. No. 6,526,939 to Reitz et al. entitled Diesel Engine Emissions Reduction by Multiple Injections Having Increasing Pressure. For this approach, electronic control of fast acting valves on common rail fuel systems is used to produce multiple injections for the reduction of particulate and NOx emissions. While the added expense and complexity associated with this type of fuel system may be justifiable for some engine applications, others may benefit from a different more simplistic and robust hydraulic control method to create either rate shaping, or rate shaping with pilot or multiple injections through the use of flow path closure within the injector.

SUMMARY OF THE INVENTION

A hydraulic flow control exemplary of aspects of the present invention is incorporated into the needle valve and needle bore adjacent the high-pressure fuel inlet passage to the injector. The fuel inlet passage communicates with a fuel inlet control volume surrounding the needle bore and defined between upper and lower metering edges. The needle valve is provided with a first control volume that interrupts the cylindrical outside surface of the needle valve head into an upper portion and a lower portion that functions as a metering ring. An aspect of the invention relates to a fuel flow passage through the needle valve connecting the first control volume to the second control volume of the injector below the head of the needle valve. The flow control defines pilot and main fuel flow paths that are dependent upon needle valve position.

The metering ring on the needle valve is positioned so that a valve annulus or clearance communicates between the fuel inlet control volume and the first control volume of the needle valve when the needle valve is in the closed position. A pilot fuel flow path is defined from the fuel inlet control volume through the valve annulus, first control volume and fuel flow passage to the second control volume. This pilot fuel flow path is open when the needle valve is in the closed position and gradually closes as the needle valve moves away from the nozzle seat. A primary fuel flow path directly from the fuel inlet control volume to the second control volume opens when the metering ring on the needle valve is raised above the lower metering edge of the fuel inlet control volume. The metering ring on the needle valve closes the pilot fuel flow path before valve movement opens the primary fuel flow path to interrupt fuel flow at a mid-range of valve travel.

Operation of the flow control is affected by the shape of the high pressure fuel pulse, e.g., the pressure vs. time curve of the pulse. For many fuel injection systems, the pulse shape varies with engine speed. At idle and low engine speeds, pressure increases relatively slowly with time so that an initial hydraulic pressure wave through the pilot fuel flow path does not have sufficient energy to move the needle valve through the mid-range of valve travel to open the primary fuel flow path. A pilot injection occurs when the needle valve returns to its closed position where a second, stronger hydraulic pressure wave moves the needle valve to its fully open position.

At higher engine speeds, the pressure of the high pressure pulse increases more rapidly, thereby giving the initial hydraulic pressure wave sufficient energy to move the valve through the mid-range of valve travel to open the primary fuel flow path. As a result, pilot injection is typically more pronounced at lower engine speeds with frequently only a change to the injection rate shape occurring at higher speeds.

The volume of fuel in each high pressure pulse also affects operation of the flow control. Under low speed, light load conditions where each pulse is of a small volume, the pilot injection may be larger than the subsequent "primary" injection. This is due to the limited overall volume of fuel being injected. As the volume of each high pressure pulse increases, the pilot injection represents a smaller portion of the total volume of fuel being injected.

BRIEF DESCRIPTION OF THE DRAWINGS

FIG. 1 is a sectional view through a fuel injector incorporating a hydraulic flow control according to aspects of the present invention;

FIG. 2 is an enlarged view of the nozzle body of the fuel injector of FIG. 1;

DETAILED DESCRIPTION OF EXEMPLARY EMBODIMENTS

Figure 3:
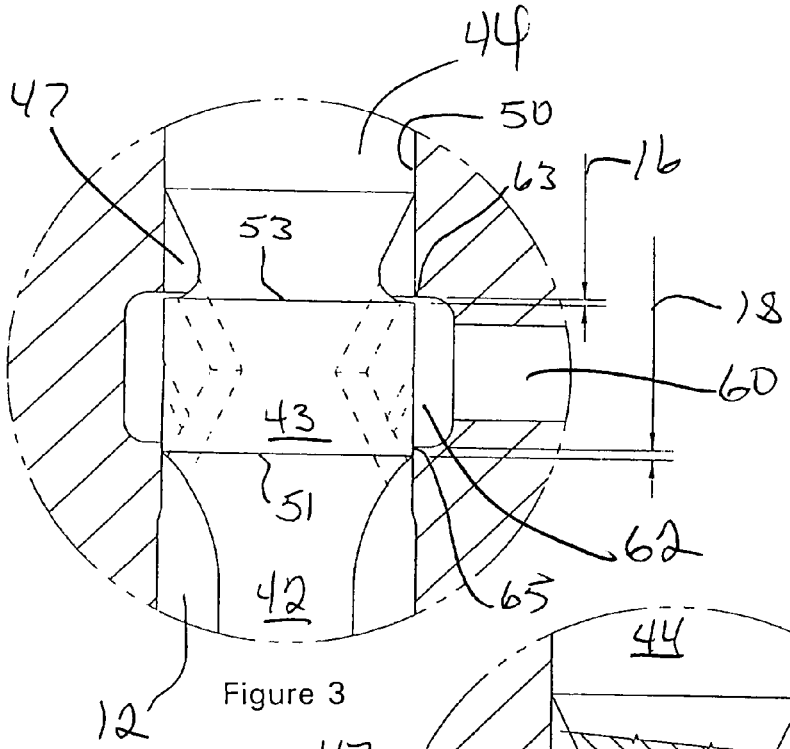
FIGS. 3 and 4 are enlarged sectional views of a first embodiment of a hydraulic flow control according to aspects of the present invention where fuel flow passages through the needle valve are shown in phantom and cut away, respectively.

With reference to the drawings wherein like numerals represent like parts throughout the figures, a fuel injector incorporating a hydraulic flow control 30 according to aspects of the present invention is generally designated by the numeral 10. In general structure and function, the fuel injector 10 is of the type in which an nozzle holder body 14 defines a needle bore 11 extending between a nozzle seat 24 and a needle guide 50. A nozzle body 20 encloses one end of the needle bore 11 and defines spray holes 22 through which fuel is injected. A needle valve 46 is received in the needle bore 11 for axial reciprocation therein between a closed position (shown in FIG. 1) and an open position. A needle valve shank 42 connects the needle valve head 44 to the needle valve tip 40. The needle valve 46 is biased toward the closed position by a pressure adjusting spring 52. A needle lift adjusting screw 54 defines the axial travel the needle valve 46 is permitted between its closed and open positions. The compression force of pressure adjusting spring 52 and the axial travel of the needle valve 46 are adjustable in a conventional manner.

The needle guide 50 of the needle bore has a greater diameter than the nozzle seat 24, providing a differential area on which fuel accumulating in the second control volume 12 operates to open the needle valve 46 against the bias of the pressure adjusting spring 52. An exemplary guide diameter is approximately 0.16 in and an exemplary seat diameter is approximately 0.08 in for a guide/seat ratio of approximately 2:1. The second control volume tends to be larger for increased guide diameters.

An aspect of the present invention relates to moving the fuel inlet passage 60 from an axial position where it would open directly into the second control volume 12 to an axial position corresponding with the needle valve head 44. The fuel inlet passage 60 communicates with a fuel inlet control volume 62 surrounding the needle bore 11. The needle valve head 44 is modified to include a first control volume 47 in the form of a circumferential groove and a fuel flow passage 45*a*, 45*b*, 45*c* connecting the first control volume 47 to the second control volume 12 below the head 44.

The needle valve head 44 is closely received in the upper portion of the needle bore 11 which acts as a needle guide 50 for controlling needle valve motion during axial reciprocation. The circumferential fuel inlet control volume 62 interrupts the needle guide 50 into an axially extended upper guide portion 50*a* and an axially truncated lower guide portion 50*b*. The fuel inlet control volume 62 is defined between upper and lower metering edges 63, 65, the lower metering edge 65 of the fuel inlet control volume 62 corresponding to an upper edge of the needle guide lower portion 50*b*.

The generally cylindrical outside surface of the needle valve head 44 is interrupted by a first control volume 47 into upper and lower outside surface portions. The head lower surface portion extends between an upper control edge 53 corresponding to the lower edge of the first control volume 47 and a lower control edge 51. The head lower surface portion operates as a metering ring 43 whose control edges 53, 51 interact with the metering edges 63, 65 of the fuel inlet control volume 62 to regulate fluid flow between the inlet 60 and the second control volume 12. The outside surface of the needle valve head 44 and the metering ring 43 are fit to adjacent surfaces on the needle valve bore 50*a*, 50*b* to minimize fluid leakage but allow free motion of the needle valve 46.

Figure 4:
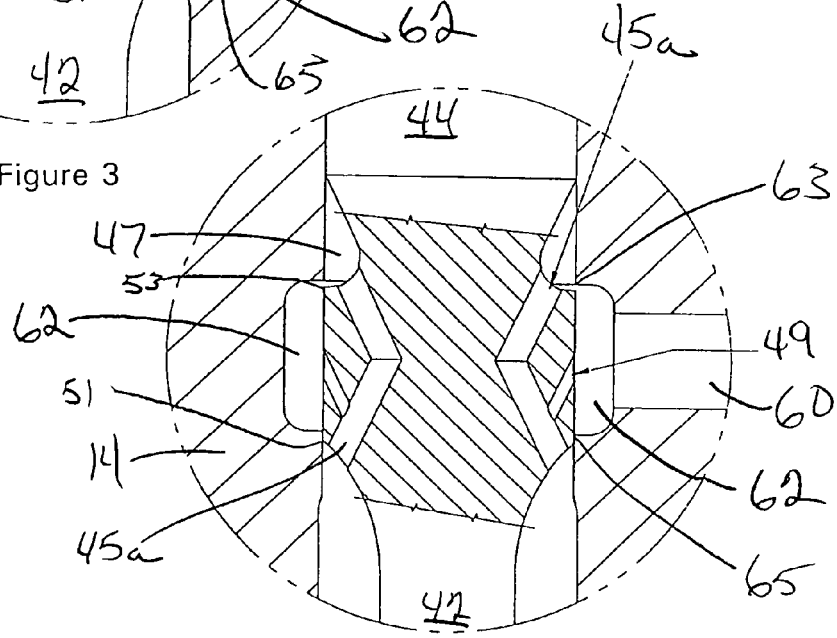
Figure 5:
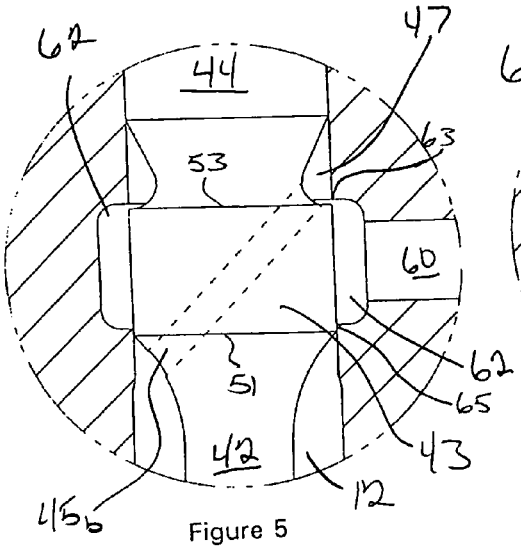
FIGS. 5 and 6 are enlarged sectional views of a second embodiment of a hydraulic flow control according to aspects of the present invention where fuel flow passages through the needle valve are shown in phantom and cut away, respectively.
Figure 6:
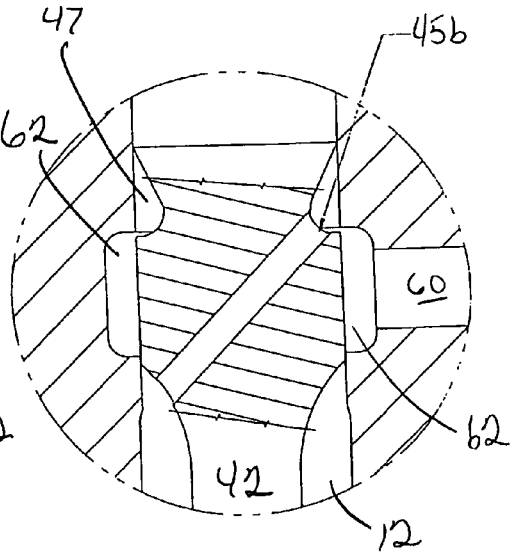
Figure 7:
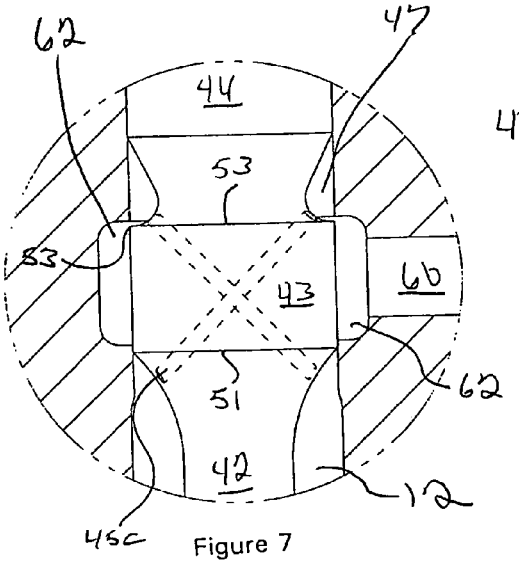
FIGS. 7 and 8 are enlarged sectional views of a further embodiment of a hydraulic flow control according to aspects of the present invention where fuel flow passages through the needle valve are shown in phantom and cut away, respectively.
Figure 8:
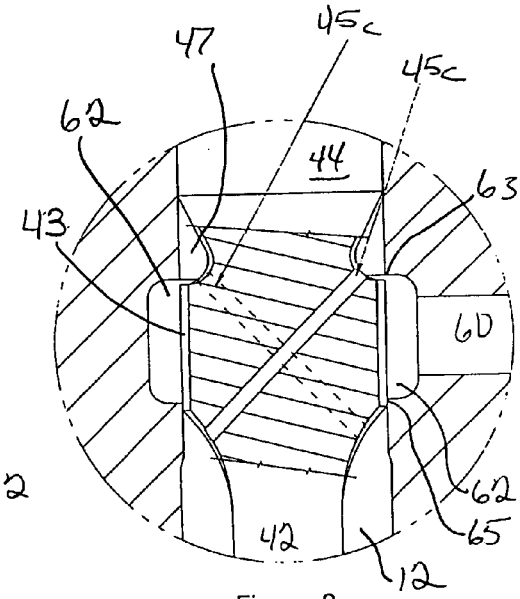

The number and shape of the fuel passage(s) 45*a*, 45*b*, 45*c* defined by the needle valve 46 are not limited to those forms illustrated and discussed herein. FIGS. 5 and 6 illustrate the fluid flow passage 45*b* as a single diagonal bore communicating between the first control volume 47 and the second control volume 12 axially below the needle valve head 44. FIGS. 7 and 8 alternatively illustrate two diagonal bores 45*c* commencing at the first control volume 47 and communicating with the second control volume 12 below the needle valve head 44. FIGS. 3 and 4 illustrate more complex fluid flow passages 45*a* formed from connecting angled bores and including metering orifices 49 communicating directly between the fuel inlet control volume 62 and the fluid flow passages 45*a*. These metering orifices 49 are an optional feature that permit adjustment of needle valve response by allowing high-pressure fuel to enter the second control volume 12 regardless of needle valve position.

Figure 11:
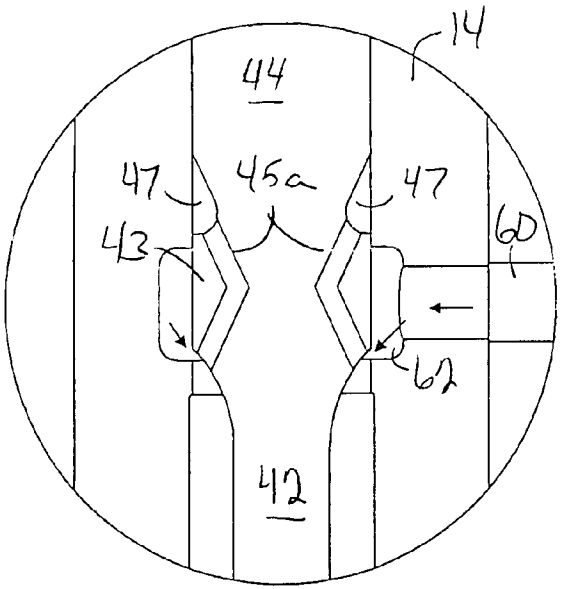
FIGS. 9 through 11 are enlarged sectional views illustrating fluid flow pathways defined by the hydraulic flow control at three of valve operational positions.
Figure 10:
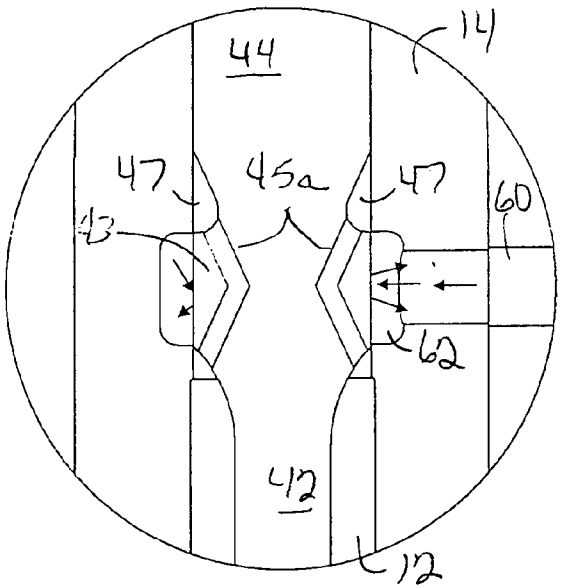
Figure 9:
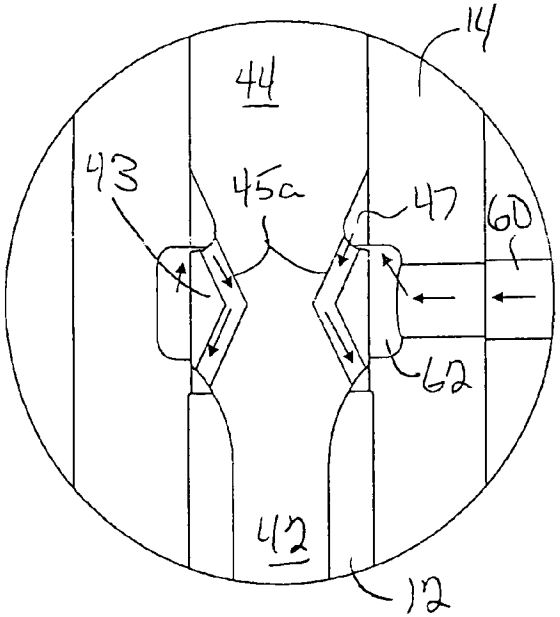

With the exception of FIGS. 10 and 11, the Figures illustrate the needle valve in its closed position. In the closed position, the lower control edge 51 of the metering ring overlaps the lower guide portion 50*b* to block fluid communication between the fuel inlet control volume 62 and the second control volume 12. The upper control edge 53 of the metering ring 43 is a predetermined axial distance below the upper metering edge 63 of the fuel inlet control volume 62 to define a fluid flow clearance 16 in the form of a valve annulus. When in the closed position and for an initial axial movement of the needle valve 46, fuel flows from the fuel inlet control volume 62 through the fluid flow clearance 16 and fuel passages 45*a*, 45*b*, 45*c* to the second control volume 12. Pressure increases in the second control volume 12 and moves the needle valve 46 away from its closed position. Axial movement of the needle valve 46 gradually closes the fluid flow clearance 16 above the metering ring 43. As shown in FIGS. 9 and 10, this initial phase of needle valve movement provides a pilot injection by lifting the needle valve tip 40 away from the nozzle seat 24 and injecting fuel through the spray holes 22 until fuel flow is interrupted by closure of the fluid flow clearance 16.

Continued axial movement of the needle valve 46 away from the nozzle seat 24 opens a second or "primary" fuel flow path when the lower control edge 51 of the metering ring 43 clears the lower metering edge 65 of the fuel inlet control volume 62 as shown in FIG. 11. This opens an unrestricted fuel flow path directly from the fuel inlet control volume 62 to the second control volume 12. The interruption of fuel flow which occurs when the metering ring 43 spans the upper and lower metering edges 63, 65 of the fuel inlet control volume 62 provides a pilot injection at low engine operating speeds. At low engine speeds, an initial hydraulic pressure wave propagates through the pilot fluid flow pathway (shown in FIG. 9) to produce an initial needle valve movement and pilot injection of fuel. At low engine speeds, the energy of this initial pressure wave is insufficient to move the needle valve 46 through the mid-range of travel shown in FIG. 10 and open a primary fluid flow pathway. Upon reaching its mid-range position, closure of the pilot fuel flow pathway causes pressure in the second control volume to decline, allowing the needle valve to reverse direction to its closed position. This reopens the pilot fluid flow path, which is exposed to hydraulic pressure that has been increasing since closure of the pilot fuel flow pathway. This second hydraulic pressure wave will have sufficient energy to move the needle valve 46 from its closed position, through the mid-range position where neither fluid flow path is open, to its fully open position as shown in FIG. 11. In the fully open position, an unrestricted fluid flow path is opened between the bottom metering edge 51 of the metering ring and the bottom metering edge 65 of the fuel inlet control volume 62.

At higher engine speeds, the initial hydraulic pressure wave will have sufficient energy to move the needle valve directly to the fully open position illustrated in FIG. 11. Thus at higher engine speeds, the pilot injection effect of the hydraulic flow control of the present invention will decline or disappear entirely to provide only a change to the rate-shape of injection.

FIGS. 3 and 4 illustrate a hydraulic flow control including optional metering orifices connecting the fuel inlet control volume to the fluid flow passage or passages. Such metering orifices can be used to adjust the rate-shape of injection by preventing complete loss of flow through the injector during mid-range valve travel. Adjustments to the size, shape and number of fluid passages through the needle valve also have an impact on behavior of the hydraulic flow control.

Figure 12:
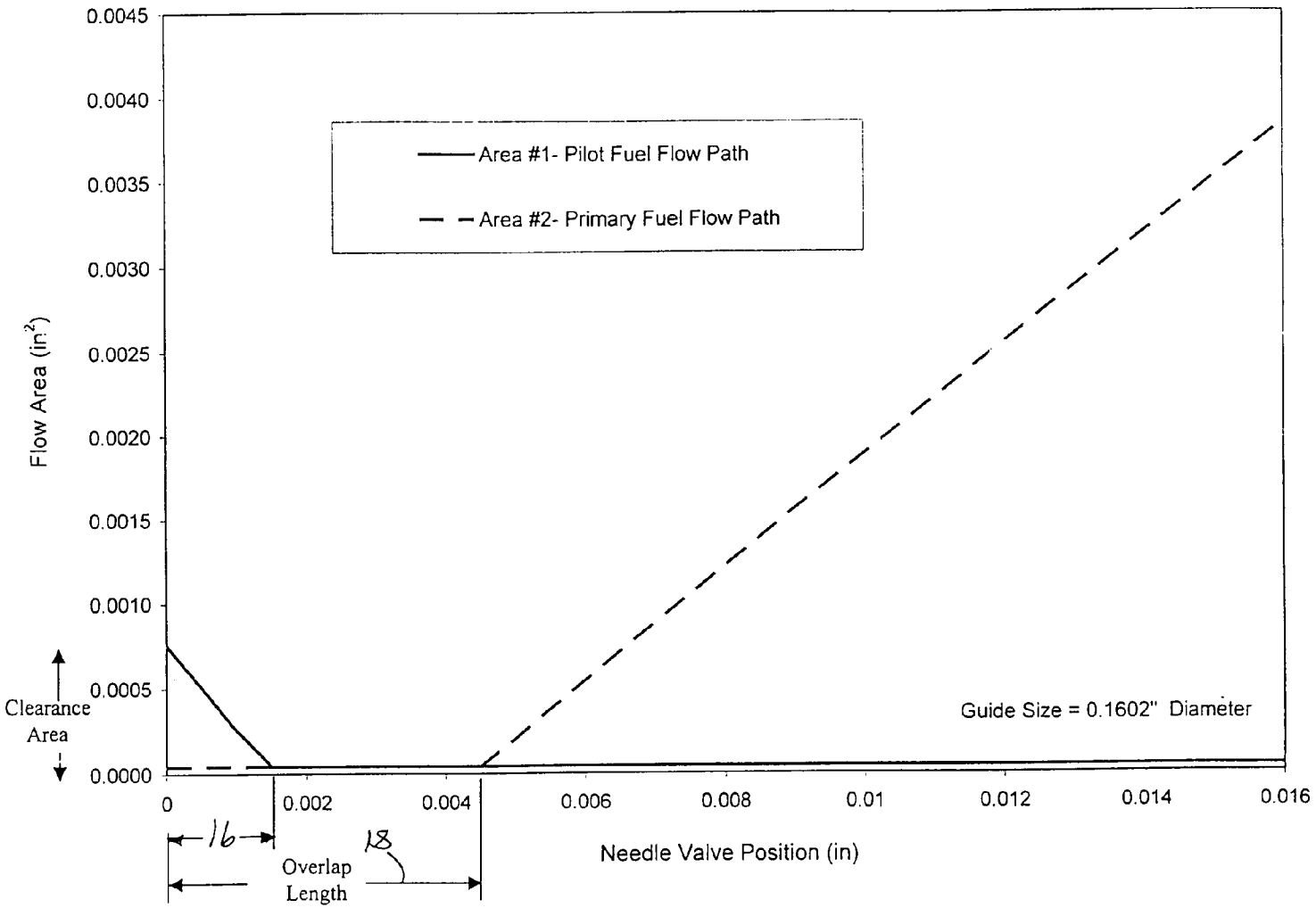
FIG. 12 is a graph of flow area as a function of needle valve position for an injector equipped with a flow control according to aspects of the present invention.

Experimentation indicates that the length of the axial dimension of the fluid flow clearance 16 relative to the axial length of the overlap 18 of the metering ring and the needle guide lower portion is important to providing a pilot injection. In the exemplary embodiment, the clearance 16 should be substantially smaller than the overlap 18. A ratio of 1:3 clearance 16 to overlap 18 has been shown to produce a distinct pilot injection over a useful range of low engine speeds. An exemplary axial clearance is 0.0015 in and an exemplary axial overlap is 0.0045 in. The axial dimension of the fluid flow clearance 16 provides an initial fluid flow area as shown in FIG. 12. FIG. 12 graphically compares the flow area through the fuel injector to the axial position of the needle valve. The flow area of the pilot fuel flow path decreases to near zero to create a fluid seal when the needle valve position exceeds the initial clearance axial dimension 16. The area of the primary fuel flow path increases from a needle valve position exceeding the overlap length 18. Maximum valve lift in the illustrated embodiment is limited by a needle lift adjusting screw to approximately 0.0156 in (0.4 mm).

While exemplary embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A fuel injector comprising:

a nozzle holder body defining a needle bore axially extending between a needle guide and a nozzle body defining a nozzle seat, said needle guide axially interrupted into upper and lower needle guide portions by a circumferential fuel inlet control volume having first upper and first lower metering edges, said nozzle holder body defining a fuel inlet passage communicating with said fuel inlet control volume; and an elongated needle valve received in said needle bore for axial reciprocation therein between a closed position and an open position, said needle valve having oppositely disposed tip and head ends axially separated by a needle valve shank, said tip end being disposed adjacent to and configured to engage said nozzle seat when said needle valve is in the closed position, said head end having an outside surface received within said needle guide and axially interrupted into outside surface upper and lower portions by a first control volume having second upper and second lower metering edges, said head end defining a fuel passage communicating between said first control volume and said needle bore axially below a bottom edge of said outside surface lower portion, the needle guide having a greater diameter than the nozzle seat to provide a differential area for hydraulically moving the needle valve away from engagement with said nozzle seat, the fuel inlet control volume being connected to receive periodic high pressure pulses of fuel for opening the needle valve against a closure bias, when the needle valve is in said closed position, said first upper metering edge and said second lower metering edge are axially spaced to define a circumferential fluid flow clearance and said lower needle guide portion axially overlaps with said outside surface lower portion, said axial overlap being greater than or equal to an axial dimension of said fluid flow clearance, whereby initial movement of said needle valve is produced by fuel flowing through said fluid flow clearance and said fuel passage to said needle bore.

2. The fuel injector of claim 1, wherein said head end outside surface and said needle guide are complementary generally cylindrical surfaces.

3. The fuel injector of claim 1, wherein needle valve movement away from said closed position restricts fluid flow between said fuel inlet control volume and said needle bore by reducing said fluid flow clearance.

4. The fuel injector of claim 1, wherein needle valve movement away from said closed position interrupts fluid flow between said fuel inlet control volume and said needle bore by closure of said fluid flow clearance.

5. The fuel injector of claim 1, wherein axial movement of said needle valve greater than said axial overlap closes said fluid flow clearance and opens a direct fluid flow path between said fuel inlet control volume and said needle bore when said outside surface portion bottom edge moves axially above said first lower metering edge.

6. The fuel injector of claim 1, wherein said axial overlap is at least twice the axial dimension of said fluid flow clearance.

7. The fuel injector of claim 1, wherein said axial overlap is approximately three times the axial dimension of said fluid flow clearance.

8. A fuel injector comprising:

a nozzle holder body defining an elongated needle bore extending between a nozzle seat and a longitudinally spaced needle guide and including a nozzle body enclosing the needle bore below the nozzle seat and defining spray holes communicating with the needle bore, said needle guide interrupted by a circumferential fuel inlet control volume to define an outer metering ring intermediate said fuel inlet control volume and said nozzle seat, said outer metering ring having an internal metering surface between axially spaced upper and lower metering edges;

a needle valve axially extending between a tip and a head, said needle valve disposed in the needle bore with a guide surface of said head received within said needle guide to control axial movement of the needle valve within the needle bore between a closed position where said tip is in engagement with the nozzle seat and an open position with a predetermined axial separation of said tip from said nozzle seat, said guide surface interrupted by a first control volume to define an inner metering ring intermediate said groove and said tip, said inner metering ring having an external metering surface between axially spaced upper and lower metering edges, said needle valve defining a fuel passage communicating between said first control volume and said needle bore axially below said inner metering ring;

a pressure adjusting spring biasing the needle valve downwardly into engagement with the nozzle seat;

the needle guide having a greater diameter than the nozzle seat to provide a differential area for hydraulically opening the needle valve against the bias of the closure spring;

the fuel inlet control volume being connected to receive periodic high pressure pulses of fuel for opening the needle valve against the bias of the closure spring and for supplying fuel for injection through the spray holes;

the inner metering ring, with the needle valve in its closed position, being received within the outer metering ring with the inner metering ring lower metering edge below the outer metering ring upper metering edge by an axial overlap greater than an axial clearance between the inner metering ring upper metering edge and an upper terminus of said fuel inlet control volume, wherein said needle valve is initially opened by fuel flowing through a first fluid flow path defined by said axial clearance, said groove and said fuel passage into said needle bore below said inner metering ring.

9. The fuel injector of claim 8, wherein axial movement of said needle valve away from said closed position closes said axial clearance, interrupting said first fluid flow path prior to opening a second fluid flow path.

10. The fuel injector of claim 8, wherein a second fluid flow path is opened upon axial movement of said needle valve away from said closed position an axial distance greater than said axial overlap, said second fluid flow path communicating directly between said fuel inlet control volume and said needle bore.

11. The fuel injector of claim 8, wherein a second fluid flow path is opened upon axial movement of said needle valve away from said closed position an axial distance greater than said axial overlap, said second fluid flow path communicating directly between said fuel inlet control volume and said needle bore, said first fluid flow path closing before opening of said second fluid flow path.

12. The fuel injector of claim 8, wherein said axial overlap is at least twice said axial clearance.

13. The fuel injector of claim 8, wherein said axial overlap is approximately three times said axial clearance.

14. A fuel injector comprising:

a nozzle holder body defining an elongated needle bore extending between a nozzle seat and a needle guide and including a nozzle body enclosing the needle bore below the nozzle seat and defining spray holes communicating with the needle bore, said nozzle holder body defining a fuel inlet passage communicating with said needle bore at an axial position corresponding to said needle guide;

a needle valve having a valve stem extending between a tip configured to engage said nozzle seat and a head having a diameter greater than said stem, said needle valve received in said needle bore with said tip adjacent said nozzle seat and said head surrounded by said needle guide, said needle valve defining a fluid passage radially inwardly through an outside surface of said head and axially downwardly toward said valve stem, said needle valve axially moveable within said needle bore between a closed position in which said tip is sealingly engaged with said nozzle seat and an open position in which said needle valve is moved away from the nozzle seat to permit fuel injection through the spray holes;

wherein said needle valve cooperates with said nozzle holder body to define a variable control volume surrounding said valve stem, said fuel inlet passage is connected to receive periodic high pressure pulses of fuel for delivery to the control volume to hydraulically open the needle valve against said bias, alternative pilot and primary fuel flow paths being defined between said fuel inlet passage and said control volume, said pilot fuel flow path extending from said fuel inlet passage through said fluid passage, said primary fuel flow path communicating directly between said fuel inlet passage and said control volume, said pilot fuel flow path being open when said needle valve is in the closed position and for a pre-determined initial axial movement of said needle valve away from said nozzle seat and opening said primary fuel flow path requires axial needle valve movement through an intermediate valve position in which said pilot fuel flow path is closed.

15. The fuel injector of claim 14, wherein initial movement of said needle valve is produced by fuel flow through said pilot fuel flow path.

* * * * *